US005388830A

United States Patent [19]

Dixson

[11] Patent Number: 5,388,830

[45] Date of Patent: Feb. 14, 1995

[54] METHOD FOR PLAYING A DICE GAME

[76] Inventor: Gary V. Dixson, 3977 Menlo Ave., No. 104, Los Angeles, Calif. 90037

[21] Appl. No.: 12,353

[22] Filed: Feb. 2, 1993

Related U.S. Application Data

[63] Continuation of Ser. No. 795,523, Nov. 21, 1991, abandoned.

[51] Int. Cl.[6] ..... A63F 9/04

[52] U.S. Cl. ..... 273/146

[58] Field of Search ..... 273/146, 245–247, 273/274, 93 R

[56] References Cited

U.S. PATENT DOCUMENTS

| | | | |
|---|---|---|---|
| 1,492,368 | 4/1924 | Funai | 273/93 R |
| 2,861,809 | 11/1958 | Fischl | 273/146 |
| 3,463,496 | 8/1969 | Weinstein et al. | 273/246 |
| 4,521,197 | 6/1985 | Lumpkins | 434/110 |
| 4,648,602 | 3/1987 | Maroney | 273/146 |
| 4,679,798 | 7/1987 | Dvorak et al. | 273/254 |
| 4,834,386 | 5/1989 | Rosenthal et al. | 273/146 |
| 4,893,816 | 1/1990 | Levy et al. | 273/146 |
| 4,900,034 | 2/1990 | Bereuter | 273/146 |
| 4,930,780 | 6/1990 | Goodman et al. | 273/146 |

FOREIGN PATENT DOCUMENTS

| | | | |
|---|---|---|---|
| 31828 | 6/1885 | Germany | 273/146 |

*Primary Examiner*—Benjamin H. Layno
*Attorney, Agent, or Firm*—David Weiss

[57] ABSTRACT

A method of playing a dice game utilizing a game die having indicia on some sides which are different in kind from indicia on other sides and producing functional relationships for facilitating the calculation of points scored in dice games wherein a plurality of such dice are used, and a deck of instruction cards drawn by election. A preferred embodiment of the die of the present invention comprises a cube including a first side having thereon the numeral 100, a second side having thereon the numeral 50, and third through sixth sides respectively having thereon two spots, three spots, four spots and six spots.

12 Claims, 1 Drawing Sheet

METHOD FOR PLAYING A DICE GAME

CROSS-REFERENCE TO RELATED APPLICATION

This is a continuing application of U.S. patent application Ser. No. 07/795,523, filed Nov. 21, 1991, by Gary V. Dixson, now abandoned.

BACKGROUND OF THE INVENTION

This invention relates to dice games, and more particularly to improved dice and method for using such dice for significantly increasing the facility with which many dice games may be played, and a dice game utilizing such dice.

Dice games generally employ one or more dice which, when thrown or rolled upon a horizontal surface, determine a score based upon indicia displayed by the upwardly facing sides of the resting dice. Each die is in the form of a six sided cube, and each side commonly has thereon different quantities of spots respectively representing the numbers 1, 2, 3, 4, 5 and 6.

Aside from the numerical differences inherent in the numbers represented on each of the six sides of a die, some games treat the numbers on some sides differently than those appearing on other sides. Such a game is described in my parent application Ser. No. 07/795,523, and another such game is described in U.S. patent Ser. No. 4,930,780 to Goodman et al., and the disclosures of both application Ser. No. 07/795,523 and Patent No. 4,930,780 are incorporated herein by reference. In each of these games, six dice are thrown and a point score is calculated based at least in part upon the same numerical values being simultaneously displayed by three dice (i.e., a "triplet"). With respect to four sides of each die, no points are counted for numerical values displayed on only one or two of the dice thrown. However, with respect to the remaining two sides of each die, additional points are counted based upon the numerical values displayed by any one of the thrown dice not included in a triplet (i.e., a "single").

In the aforementioned Goodman et al. patent, each die is of conventional type having one, two, three, four, five and six spots on its six sides, respectively, and the point values are scored based on the numbers displayed on the dice when thrown as follows:

Single 1's=100
Single 5's=50
Three 1's=1000
Three 2's=200
Three 3's=300
Three 4's=400
Three 5's=500
Three 6's=600

It is noted that each triplet displaying two, three, four, five or six spots results in point values of one-hundred times the number of spots displayed, whereas each triplet displaying only one spot results in a point value of one-thousand times that displayed number. In addition, each single displaying two, three, four or six spots results in no point value, whereas each single displaying one spot results in a point value of one-hundred times that displayed number and each single displaying five spots results in a point value of ten times that displayed number.

The number 1 is operated upon by a different factor (i.e., multiplied by 1000) than that for the numbers on the other five sides (i.e., multiplied by 100) for calculating the point value for each triplet, while the numbers 1 and 5 are additionally operated upon by different factors (i.e., multiplied by 100 and by 10, respectively) for calculating the point value for each single. Since all six sides contain spots, there is nothing to indicate which of the various treatments are to be applied to the displayed numbers, and either frequent reference to a rule book or the good collective memory of the various players is required. It may be appreciated that such inconsistent mathematical operations applied to each of the two sides containing one spot and five spots with respect to each other and in addition with respect to the other four sides of each die, tends to create player confusion and is conducive to errors in score calculation.

SUMMARY OF THE INVENTION

The dice of the present invention, as disclosed in my co-pending application Ser. No. 07/795,523, avoids these problems associated with conventional dice utilized in games of the types discussed therein and in the aforesaid Goodman et al. patent. By utilization of the dice of the present invention in such games, the calculation of point score is greatly facilitated.

According to the present invention, in a dice game wherein a score is based upon the same numerical values displayed by three dice (i.e., a triplet) resulting from a roll or throw of a plurality of dice in addition to being based upon particular numerical values displayed by fewer than three dice (i.e., one or more singles) of such thrown plurality of dice, the plurality of dice comprises at least three and preferably six dice, each die of which includes six sides having indicia thereon representing different numerical values, the indicia on at least one but not all of such sides representing such particular numerical values being distinguishable in kind from the indicia on other ones of such sides. The fact that the two indicia are different in kind results in a signal to the players that the displayed particular numbers are to be treated differently than the other numbers when calculating the point score. Specifically, the indicia representing the particular numerical values signal that all singles thereof are to contribute to the point score, that such particular numerical values display the actual points to be scored for each single thereof, and that such particular numerical values are to be operated upon by a common factor for calculating the point score for each triplet thereof. The indicia on the other ones of the die sides signal that singles thereof are not to be counted for calculating point score, and that the numeral values thereon are operated upon by a second common factor for calculating the points to be scored for each triplet thereof.

Preferably the indicia on two of the sides of each die respectively representing two of the particular numerical values are distinguishable in kind from the indicia on the other four of the sides of such die. The indicia on each of such two sides are similar in kind, while the indicia on the other four sides of each die are similar in kind (although dissimilar in kind from the indicia on the two sides representing the two particular numerical values). More specifically, the indicia representing the two particular numerical values are Arabic numerals, while the indicia on the other four sides of each die are spots the quantities of which respectively represent the different numerical values other than the two particular numerical values. In a preferred embodiment of the improved die according to the present invention, the indicia representing the particular numerical values on the two sides of each die comprise the numerals 100 and 50, respectively; while the indicia representing the different numerical values on the other four sides of each die comprise two spots, three spots, four spots and six spots, respectively.

A method of playing a dice game using the preferred embodiment of the dice of the present invention comprises the steps of (1) providing at least three and preferably six dice, each die of which comprises a cube having six sides including a first side having thereon the numeral 100, a second side having thereon the numeral 50, a third side having thereon two spots, a fourth side having thereon three spots, a fifth side having thereon four spots, and a sixth side having thereon six spots; (2) throwing the dice for displaying a side of each die; and (3) calculating a point count or score including the steps of (a) multiplying by 100 the number of displayed spots on one such die for each triplet thereof, if any, (b) multiplying by 10 the displayed numbers 100 and 50 on one such die for each triplet thereof, if any, (c) taking the actual value of the displayed numbers 100 and 50 for each single thereof, if any, and (d) adding the results of steps (a), (b) and (c).

Since the numbers or numerical values expressed by Arabic numerals (i.e., 100 and 50) are inherently distinguishable from the numbers or numerical values expressed by quantities of spots, the game players readily recognize that their treatment is to be different. With respect to the sides containing spots, singles are not counted and triplets are operated upon by the multiplier 100. With respect to the sides containing the Arabic numerals 100 and 50, singles are counted at their face value (i.e., no multiplier is utilized) and triplets are operated upon by the multiplier 10. By means of the dice of the present invention, it may be appreciated that dice games of the type described are simplified and minimize the likelihood of score count errors, and are accordingly susceptible of greater player enjoyment.

A feature of the dice game of the present invention includes providing a deck of cards each having an instruction thereon, and then, if the calculation of point score in the last preceding throw results in points scored, drawing a card from such deck if electing to do so and following the instruction contained on the drawn card. If a player elects to draw a card from the deck, he must again throw the dice not contributing to points scored from his last preceding throw unless the drawn card contains an instruction inconsistent with his again throwing the dice.

BRIEF DESCRIPTION OF THE DRAWINGS

The novel features which are believed to be characteristic of the invention, together with further advantages thereof, will be better understood from the following description considered in connection with the accompanying drawings in which a preferred embodiment of the invention and its utilization are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
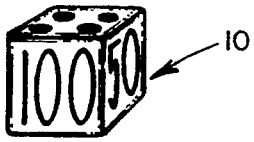
FIG. 1 is a perspective view of a preferred embodiment of a die according to the present invention.

A preferred embodiment of a die 10 is shown in FIGS. 1 through 7, and comprises a cube (FIG. 1) having a first face or side 12 upon which the Arabic numeral "100" is applied (see also FIG. 2), a second side 14 (FIG. 3) upon which the Arabic numeral "50" is applied, a third side 16 (FIG. 4) upon which two spots 18 are applied, a fourth side 20 (FIG. 5) upon which three spots 18 are applied, a fifth side 22 (FIG. 6) upon which four spots 18 are applied, and a sixth side 24 (FIG. 7) upon which six spots 18 are applied. Although other arrangements are of course possible, the sides of the die 10 may be structurally arranged such that, as viewed in FIG. 1, the second side 14 is adjacent to and to the right of the first side 12, the third side 16 is adjacent to and to the left of the first side 12, the fourth side 20 is adjacent to and beneath the first side 12 (i.e., the fourth side 20 would be a bottom plan view of the die 10 as viewed in FIG. 1), the fifth side 22 is adjacent to and above the first side 12 (i.e., the fifth side 22 would be a top plan view of the die 10 as viewed in FIG. 1), and the sixth side 24 is opposite the first side 12 (i.e., the sixth side 24 would be a rear elevation view of the die 10 as viewed in FIG. 1).

The Arabic numerals "100" and "50" contained on the first and second sides 12, 14 of the die 10, and their functional relation to each other and to the other four sides 16, 20, 22, 24 of the die 10 containing thereon the spot symbols, provide the die 10 with significant advantages when used in dice games of the types previously discussed or referred to herein. In such games wherein at least three and typically six such dice 10 are rolled or thrown by a player, the point score resulting from a roll or throw is calculated as follows:

Single Arabic 100's=100 points
Single Arabic 50's=50 points
Three Arabic 100's=100×10=1000 points
Three Arabic 50's=50×10=500 points
Three spot 2's=2×100=200 points
Three spot 3's=3×100=300 points
Three spot 4's=4×100=400 points
Three spot 6's=6×100=600 points As is evident from the above table, the two sides 12, 14 containing the Arabic numerals "100" and "50" are treated differently from the four sides 16, 20, 22, 24 containing quantities of spots 18. When either of the first or second sides 12 or 14 is displayed by a die 10, the displayed Arabic numeral "100" or "50" signals to the players that the score is to be computed differently than if a spotted side 16, 20, 22 or 24 were displayed. First, a single Arabic "100" or "50" is to be counted in the point score, and further such count is in the amount of its face or numerical values, i.e., 100 points for a single "100" and 50 points for a single "50". When an Arabic "100" or "50" is displayed on each of three dice 10, the players are signaled that such a triplet is to be treated differently than a triplet where the sides of three dice display the same spot pattern. Each Arabic "100" triplet is to be treated in the same manner as the Arabic "50" triplet; specifically, each Arabic "100" or "50" triplet is to be scored by multiplying the face value of the numeral displayed on one die of the triplet by the factor ten, so that each Arabic "100" triplet is scored at 1000 points and each Arabic "50" triplet is scored at 500 points. For triplets comprised of the spotted sides 16, 20, 22 or 24, a point score is calculated by multiplying the number of spots on the displayed side of one of the three dice 10 of the triplet by the factor one-hundred, i.e., a triplet of two spots has a point score of 200 points, a triplet of three spots has a point score of 300 points, a triplet of four spots has a point score of 400 points, and a triplet of six spots has a point score of 600 points.

Figure 8:
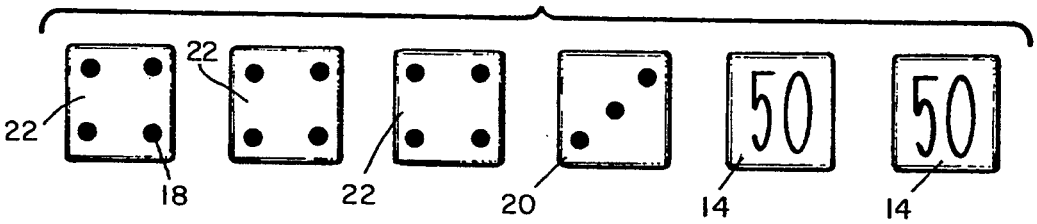
FIG. 8 is a top plan view of the upwardly facing or displayed sides of six dice of the preferred embodiment of FIG. 1, following a roll or throw of such dice, as an example for describing the method of playing dice games and calculating point score.

For example, a roll or throw of six dice 10 may result in the displayed sides shown in FIG. 8, i.e., three fifth sides 22 each displaying four spots 18, one fourth side 20 displaying three spots 18, and two second sides 14 each displaying the Arabic numeral "50". Such a throw results in one triplet of four spots, for a calculated score of 400 points (the face value 4 multiplied by 100). The single three-spotted side 20 has no point value, as signaled by the fact that the side 20 has spots 18. The two second sides 14 are recognized as having Arabic numerals thereon and therefore are to result in point count; each of the two sides 14 represents a single Arabic "50", each to be scored at its face value of 50 points. Accordingly, upon adding the various point values of the configuration thrown in the display of FIG. 8, the total point score for that throw is $400+0+50+50=500$ points.

Figure 9:
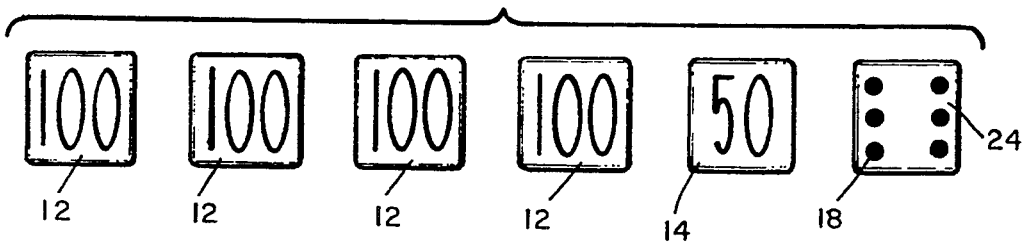
FIG. 9 is a top plan view of the upwardly facing or displayed sides of six dice of the preferred embodiment of FIG. 1, following a roll or throw of such dice, as another example of the method of playing dice games and calculating point score.

The second example of FIG. 9 shows the six displayed sides from a roll or throw of six dice 10. The displayed sides comprise four first sides 12 containing the Arabic numeral "100", one second side 14 displaying the Arabic number 50, and one sixth side 24 displaying six spots 18. The players are aware that each of the sides containing an Arabic numeral will contribute to the point score, but that only a triplet including three spotted sides will contribute to a point score so that the spotted sixth side 24 may be eliminated from further consideration. The four first sides 12 include one triplet and one single of the Arabic numeral "100"; the point score for the triplet is 1000 (i.e., the face value 100 multiplied by the factor 10), and the point score for the single "100" is its face value or 100 points. Similarly, the point score for the single "50" represented by the single displayed second side 14 is its face value or 50 points. Accordingly, the total point score for the displayed sides of FIG. 9 is $1000+100+50+0=1,150$ points.

In games of the type described in my aforementioned parent application, and in the aforementioned Goodman patent, the disclosures of which have been incorporated herein by reference, a player may continue to throw again any dice not contributing to point score in the last preceding throw, provided such last preceding throw resulted in points scored. If he elects not to continue to throw such dice again, the player's score is recorded as the sum of the points scored during that turn, i.e. during his sequence of consecutive throws just prior to making such election. If he elects to continue and throws again the dice not contributing to point score in the last preceding throw, however, and on the next following throw no points are scored, the player loses all of his accumulated points from that sequence of throws as well as ending his turn.

Figure 10:
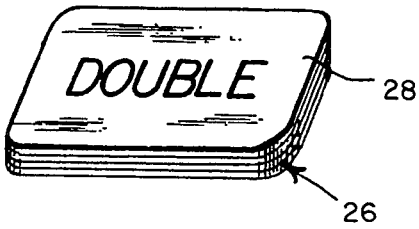
FIG. 10 is a perspective view of a deck of cards for use in the game of the present invention.
Figure 2:
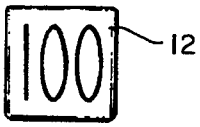
FIG. 2 is a view of a first side of the die of FIG. 1.
Figure 3:
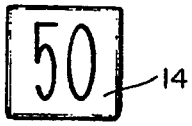
FIG. 3 is a view of a second side of the die of FIG. 1.
Figure 4:
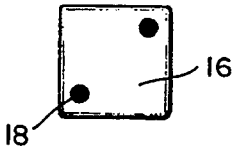
FIG. 4 is a view of a third side of the die of FIG. 1.
Figure 5:
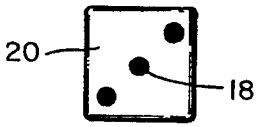
FIG. 5 is a view of a fourth side of the die of FIG. 1.
Figure 6:
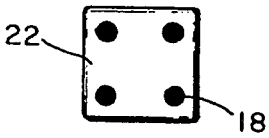
FIG. 6 is a view of a fifth side of the die of FIG. 1.
Figure 7:
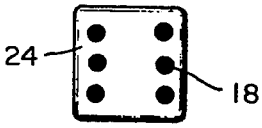
FIG. 7 is a view of a sixth side of the die of FIG. 1.

Turning to FIG. 10, a feature of the dice game of the present invention is the provision of a deck 26 of cards 28 each of which contains an instruction on its face. For example, the instruction on the card 28 shown in FIG. 10 directs the player to double his point score. Other cards may contain instructions for adding or subtracting points from his point score, or to miss his next turn, or to end or lose his present turn. It is noted that the card 28 is shown in FIG. 10 with its instruction-containing face upwardly directed; in actuality, each of the cards 28 of the deck 26 would be positioned such that their instruction-containing faces are downwardly directed and hidden from view. Normally, a player will take the uppermost card 28 from the deck 26.

If a player's last preceding throw results in points scored, the player may elect to draw a card 28. If he does so, he must follow the instruction on the drawn card and then—unless the drawn card has instructed him to end or lose his present turn or otherwise contains an instruction inconsistent with again throwing the dice-he must continue his turn by again throwing the dice not contributing to point score on his last preceding throw. This feature of the present invention provides an added challenge to the player, since he must decide whether to end his turn while he has points to record or, by electing to draw a card 28, to risk losing these points by committing himself to the possibility of another throw of the remaining dice, and in addition to risk points as may be instructed by the drawn card.

Thus, there has been described an improved die for use in dice games, as well as a method of playing dice games wherein a plurality of such dice may be used, in which the indicia on some of the sides are different in kind from the indicia on the other sides of the die, producing functional relationships among the various sides which permit significant advantages when used in such dice games. The dice game further includes the drawing of instruction cards from a deck in accordance with elections made by the players. Other embodiments of the die and variations in the method of its use and for playing the game may be developed without departing from the essential characteristics thereof. Accordingly, the invention should be limited only to the scope of the claims listed below.

I claim:

1. A method of playing a dice game comprising the steps of:

(1) providing a plurality of at least three dice, each die of which comprises a cube having six sides including a first side having thereon the numeral 100, a second side having thereon the numeral 50, a third side having thereon two spots, a fourth side having thereon three spots, a fifth side having thereon four spots, and a sixth side having thereon six spots;

(2) throwing said plurality of dice for displaying a side of each said die; and (3) calculating a point score including the steps of (a) multiplying by one hundred the number of displayed spots on one said die for each triplet thereof, if any, (b) multiplying by ten the display numbers 100 and 50 on one said die for each triplet thereof, if any, (c) taking the actual value of the displayed numbers 100 and 50 for each single thereof, if any, and (d) adding the results of steps (a), (b) and (c).

2. The method according to claim 1, wherein:

said plurality of dice provided in step (1) is six.

3. The method according to claim 1, further including the steps of:

if the calculation according to step (3) results in point score, throwing again any of said dice not contributing to point score if electing to do so and calculating point score from said thrown-again dice according to step (3).

4. The method according to claim 3, further including the steps of:

providing a deck of cards each having an instruction thereon; and if the calculation according to step (3) results in point score for the last preceding throw of any of said dice thrown, drawing a card from said deck if electing to do so and following the instruction contained on said card.

5. The method according to claim 4, further including the step of:

if electing to draw a card from said deck, throwing again any of said dice not contributing to point score from said throw last preceding said drawing of said card unless said drawn card contains an instruction inconsistent with again throwing said dice.

6. A method of playing a dice game comprising the steps of:

(1) providing a plurality of at least three dice, each die of which includes six sides having indicia thereon representing different numerical values, said indicia on at least one but not all of said sides representing particular numerical values being distinguishable in kind from said indicia on the other ones of said sides;

(2) throwing said plurality of dice for displaying a side of each said die; and (3) calculating a point score including the steps of (a) taking the actual value of said particular numerical values represented by said indicia displayed for each single thereof, if any, (b) multiplying by a first common factor said particular numerical values represented by said indicia displayed on one said die for each triplet thereof, if any, (c) multiplying by a second common factor the numerical values represented by said indicia on said other ones of said sides displayed on one said die for each triplet thereof, if any, and (d) adding the results of steps (a), (b) and (c).

7. The method according to claim 6, wherein: p1 during said providing step, said indicia on two of said sides of each said provided die respectively representing two of said particular numerical values are distinguishable in kind from said indicia on said other ones of said sides.

8. The method according to claim 6, wherein:

during said providing step, said indicia on said two sides of each said provided die are similar in kind.

9. The method according to claim 6, wherein:

said plurality of dice provided in step (1) is six.

10. The method according to claim 6, further including the steps of:

if the calculation according to step (3) results in point score, throwing again any of said dice not contributing to point score if electing to do so and calculating point score from said thrown-again dice according to step (3).

11. The method according to claim 10, further including the steps of:

providing a deck of cards each having an instruction thereon; and if the calculation according to step (3) results in point score for the last preceding throw of any of said dice thrown, drawing a card from said deck if electing to do so and following the instruction contained on said card.

12. The method according to claim 11, further including the step of:

if electing to draw a card from said deck, throwing again any of said dice not contributing to point score from said throw last preceding said drawing of said card unless said drawn card contains an instruction inconsistent with again throwing said dice.

* * * * *